US006487972B1

(12) United States Patent
Cook et al.

(10) Patent No.: US 6,487,972 B1
(45) **Date of Patent: *Dec. 3, 2002**

(54) ELECTRIC PRIMER

(75) Inventors: Todd D. Cook, Cecilia, KY (US); Dale R. Danner, Eastview, KY (US); Diane Ronkainen, Hodgenville, KY (US); David K. Schluckebier, Elizabethtown, KY (US)

(73) Assignee: RA Brands, LLC, Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/501,668

(22) Filed: Feb. 10, 2000

Related U.S. Application Data

(63) Continuation-in-part of application No. 08/988,898, filed on Dec. 11, 1997, now Pat. No. 6,131,515.

(51) Int. Cl.[7] ..... F42B 3/14

(52) U.S. Cl. ..... 102/202.8; 2/202.1; 2/202.14; 2/472

(58) Field of Search ..... 102/202.1, 202.2, 102/202.5, 202.7, 202.8, 202.9, 202.14, 472

(56) References Cited

U.S. PATENT DOCUMENTS

| | | | | |
|---|---|---|---|---|
| 800,056 | A | 9/1905 | Bailey | |
| 1,034,160 | A | 7/1912 | Starkweather | |
| 1,084,745 | A | 1/1914 | Lindsay | |
| 2,972,951 | A | 2/1961 | Stresau | 102/70.2 |
| 3,018,732 | A | 1/1962 | Tognola | 102/70.2 |
| 3,090,310 | A | 5/1963 | Peet et al. | 102/46 |
| 3,286,631 | A | 11/1966 | Gawlick et al. | 102/70.2 |
| 3,390,636 | A | 7/1968 | Perkins et al. | 102/28 |
| 3,455,244 | A | 7/1969 | Ballreich et al. | 102/86.5 |
| 3,499,386 | A | 3/1970 | Satadler et al. | 102/86.5 |
| 3,779,167 | A | 12/1973 | Irish, Jr. et al. | 102/46 |
| 3,783,788 | A | 1/1974 | Hayashi | 102/28 |
| 3,844,216 | A | 10/1974 | Jakobs et al. | 102/46 |
| 3,862,601 | A | 1/1975 | Rentzsch et al. | 102/49.3 |
| 4,014,264 | A | 3/1977 | Bendler et al. | 102/46 |
| 4,287,394 | A | 9/1981 | Hargita et al. | 200/5 A |
| 4,329,924 | A | 5/1982 | Lagofun | 102/202.8 |
| 4,386,567 | A | 6/1983 | Ciccone | 102/202.5 |
| 4,464,990 | A | 8/1984 | Bendler et al. | 102/204 |
| 4,676,164 | A | 6/1987 | Carter et al. | 102/204 |
| 5,027,707 | A | 7/1991 | Mei | 102/202.8 |
| 5,044,278 | A | 9/1991 | Campbell | 102/202.8 |
| 5,208,423 | A | 5/1993 | Goetz | 102/472 |
| 5,361,702 | A | 11/1994 | Goetz | 102/472 |
| 5,485,786 | A | 1/1996 | Hesse et al. | 102/202.5 |
| 5,515,783 | A | 5/1996 | Hesse et al. | 102/206 |
| 6,272,993 | B1 * | 8/2001 | Cook et al. | 102/472 |

OTHER PUBLICATIONS

Peek tm manufacturer, Victrex, Ltd., "Material Properties".

Chang–Meng Hsiung, et al., "Crystallization Phenomena in Injection Molding of Poly Ester Ketone and Its Influence Mechanical Properties", Polymer Engineering and Science [University of Akron], vol. 30; No. 16, pp. 967–980 (Aug. 1990).

"Progress Report RDR–45–60, Fuse Igniter Primers—Engineer Board Corps of Engineers, U.S. Army"; Remington Arms Company, Inc., Nov. 13, 1945.

"Final Report AB–52–14, Basic Research on Electrical Ignition, Contract DA–19–059–ORD–278"; Remington Arms Company, Inc.; Sep. 26, 1952.

"Final Report AB–55–6, Electric Ignition Systems Contract No. DA–19–059–ORD–1735, Ordinance Project TS1–47–11"; Remington Arms Company, Inc.; May 15, 1955.

(List continued on next page.)

*Primary Examiner*—Harold J. Tudor

(74) *Attorney, Agent, or Firm*—Womble Carlyle Sandridge & Rice, PLLC

(57) ABSTRACT

An electric primer for the discharge of ammunition suitable for use with small arms.

20 Claims, 1 Drawing Sheet

OTHER PUBLICATIONS

"Final Summary Report, AB–55–3, Fabrication of Cartridge, Gun charger, Caliber .38, with Electric Primer, Contract DA–19–059–ORD–1636, Project TS1–47"; Remington Arms Company, Inc.; Mar. 31, 1955.

"AB–63–1 Final Summary Report, Development and Fabrication of Electric Gun Caliber .30 Contract DA–19–020–ORD–5589"; Remington Arms Company, Inc.; Feb. 21, 1963.

* cited by examiner

ELECTRIC PRIMER

CROSS-REFERENCE TO RELATED APPLICATION

This application is a continuation-in-part of U.S. patent application Ser. No. 08/988,898, filed Dec. 11, 1997 now U.S. Pat. No. 6,131,515.

BACKGROUND OF THE INVENTION

Electric primers have previously been used for the discharge of a variety of military arms, which generally are larger than what are typically considered small arms (0.50 caliber and smaller), such as 20 mm and 0.60 caliber firearms systems. In such conventional electric primers a finite quantity of primer mix is required to reliably activate/ignite the propellant of a round for a given volume of the propellants of different cartridges. The quantity of primer mixes for military ammunition can generally be varied as needed to reliably ignite the secondary propellants given the relatively larger sizes and internal volumes of such 20 mm–0.60 caliber ammunition. In fact, there is excess airspace in the larger primer designs of such ammunition.

In the development of electrically actuated smaller caliber firearms, however, the primer for such calibers is significantly smaller than the existing 20 mm primer used in a variety of military products, i.e., as small as $1/7^{th}$ the size of 20 mm caliber military electrically activated primers, while the chamber pressures generated in the discharge of such small caliber firearms are generally in a comparable range of approximately 60 kpsi. It therefore has been difficult to provide a commercial small caliber primer of a size appropriate for use in small caliber firearms that can be reliably activated by electrical current and structurally withstand the comparable range of general chamber pressures, but without the risk of activation by undesired sources, such as electrostatic discharge, magnetic fields, electromagnetic radiation, such as that emanating from electrical power lines and transformers and radio frequency transmitters.

SUMMARY OF THE INVENTION

The present invention is directed to an electric primer primarily for use in small arms ammunition that functions reliably with such small caliber ammunition. The instant invention provides an electric primer for small arms ammunition generally comprising:

(a) an electrically conductive cup having a bottom with an aperture formed therein;

(b) an electrically conductive explosive within an inner chamber defined within the cup;

(c) an electrically conductive contact positioned between the explosive and the bottom of the cup for transmitting an electric charge to the explosive to initiate the discharge of the explosive, and having a portion extending toward and projecting at least partially into the aperture in the bottom of the cup;

(d) an insulating liner generally received within the cup, separating the cup from the contact, with the insulating liner being formed from polymeric material; and (e) a retaining means generally positioned over the explosive.

The conductive explosive is configured to form an electrical path between the electrically conductive contact and the cup. The insulating liner further generally is configured to fit between the contact and the cup to retain the electrically conductive contact within the cup after discharge of the explosive. As a result, upon the discharge of the explosive, the electrically conductive contact is reshaped to an extent sufficient to substantially seal the aperture of the cup against leakage of combustion gases created by the discharge of the explosive material.

Various objects, features and advantages of the present invention will become apparent to those skilled in the art upon reading the following specification, when taken in conjunction with the accompanying drawings.

DETAILED DESCRIPTION OF THE INVENTION

Figure 1:
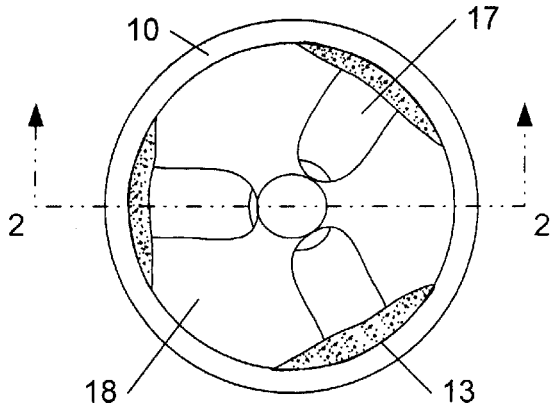
FIG. 1 is a top plan view of the primer of the present invention.
Figure 2:
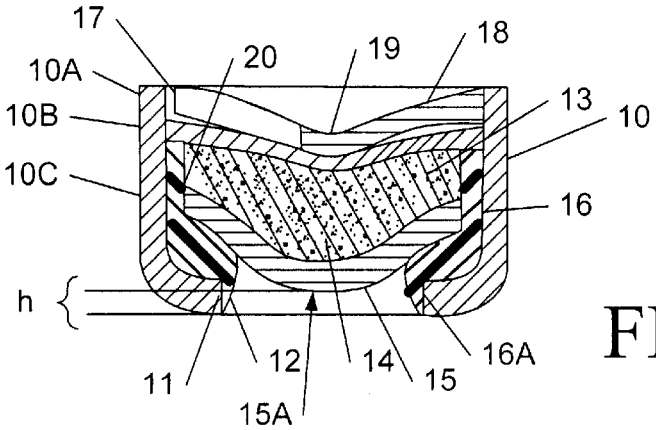
FIG. 2 is a cross-sectional view in elevation taken along line 2—2 of FIG. 1, illustrating a primer of the present invention.

The present invention will be more fully understood by reference to FIGS. 1–4, which illustrates example embodiments of the electrically activated primer of the present invention. FIG. 2 shows a first preferred embodiment of the primer in cross-section. The primer generally includes an electrically conductive cup 10, having a bottom 11, with an aperture 12 formed in the bottom, and an electrically conductive explosive primer mix material 13 received therein. The side walls of the cup generally are shaped to facilitate assembly of the primer. Specifically, in this first preferred configuration, the upper portion of the side walls 10A are substantially straight, with the cup internal diameter having its greatest circumference at this point. A tapered section 10B is provided to aid in the insertion of the components, followed by a second substantially straight section 10C. As will be understood by those skilled in the art, the cup can be prepared from a wide variety of electrically conductive materials, of which brass is preferred.

The primer cup typically will be of a similar size to a conventional primer, i.e., having a diameter of $^{140}/_{1000}$–$^{250}/_{1000}$ inches and a height of approximately ⅛ inch to 3/32 inch. The side walls 10A–10C of the cup and bottom 11 define an open-ended inner or internal chamber 14 within the cup. Typically, the total volume occupied by the primer itself is within a range of approximately 0.001 cubic inches to approximately 0.010 cubic inches, preferably 0.002–0.005 cubic inches. This volume further can be less than 0.01 cubic inches. The total volume of the primer generally varies upon the size and/or caliber of the round, and is sized to receive a sufficient amount of explosive primer mix material necessary to ignite the propellant material of the particular size or caliber round for reliably firing the round. Typically, the volume of the explosive primer mix material received in the internal chamber of the primer cup will comprise approximately 12% to 18% of the total volume of the primer.

An electrically conductive contact 15 is positioned between the explosive and the bottom of the cup, and has a nipple portion 15A extending toward the aperture in the bottom of the cup. The nipple should extend at least partially into and preferably substantially fill the aperture. The nipple projects at least partially through the aperture without engaging the cup, to enable the nipple to be contacted by an electrode or similar electrically conductive member such as an electrically conductive firing pin (not shown). Upon firing, the contact is at least partially reshaped and does not lose the original press fit attained on assembly. If a contact without a nipple portion were used, then the contact could be reshaped to too great an extent to fill the available space not supported by the firing pin or electrode and thus could stretch the thin material to a point of rupture so as to permit undesirable gas leakage or loss of the original press fit. In the latter condition, a leakage does not normally occur, however, the contact will freely move within the primer (after firing) and could prevent depriming the spent shell. Reusing the shell would consequently be impossible if depriming is prevented. The nipple shape of the contact also provides additional volume within the primer for primer mix.

The aperture formed in the bottom of the cup generally is of sufficient size to permit an electrode to contact the electrically conductive contact within the cup without touching the cup itself. As with the cup, a variety of conductive materials can be used for the contact, particularly materials that are somewhat ductile or deformable, with brass being a preferred conductive material so that as the explosive material of the primer mix is initiated or exploded, the contact will be reshaped to an extent sufficient to fill the aperture of the cup and seal the cup against leakage of discharge gases created by the discharge of the explosive primer mix material and ignition of the secondary propellant of the round of ammunition.

In the design and adaptation of the contact to particular calibers/types of ammunition, the thickness of the primer contact generally will vary across its length from approximately 0.01 inches to 0.030 inches. Typically, the nipple portion 15A will be the thinnest point along the contact, generally being approximately between 0.010 to 0.015 inches thick, typically approximately 0.014 inches thick. The geometry of the system thus enables thinner materials to be used for the contact to enable a sufficient amount of explosive material to be received within the internal chamber of the primer cup to reliably ignite the propellants of various small caliber ammunition.

In addition, the distance from the cup bottom to the nipple of the contact (h) which extends into the aperture formed in the cup bottom depends on the configuration and geometry of the system. Specifically, the minimum distance (h) selected to avoid geometrically attracting an electrostatic discharge (ESD) from a source is related to the diameter of the aperture, the distance from the ESD source to the nipple of the contact, and the radius of the ESD source. This distance is defined by the following equation:

$$h=R+L-(\sqrt{(2R+2L)^{2-D^2}})/2$$

wherein R is the radius of the tip of the ESD source, L is the maximum distance from the source to the nipple contact and D is the diameter of the hole in the primer cup. Using this formula, assuming the worst case radius of the ESD source, the geometry of the cup assembly can be adjusted to ensure than an ESD source generally will always substantially discharge to the grounded cup, thus avoiding an electrical current passing through the explosive primer mix material. The distance (h) of the design typically will also be deeper than the minimum calculated depth. Thus, the electrode or firing pin of the firearm can touch or engage the contact without engaging the cup so that the electric charge for firing the round of ammunition is transmitted by the electrode only to the contact and from there passes through the explosive material to the primer cup to ensure ignition of the explosive material.

As shown in FIG. 2, a direct electrical path is provided, through the primer mix, from the contact to those portions of the cup not covered by an insulating liner 16, including through a retaining means 17 and 18, when a conductive retaining means is used.

Figure 3:
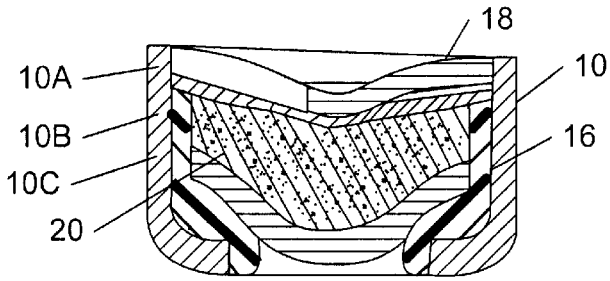
FIG. 3 is a cross-sectional view in elevation of an alternative primer of the present invention.

In an alternative embodiment, shown in FIG. 3, the insulating liner extends to the retaining means. In this case, the electrical path to the cup is solely through the retaining means and its conductive portions.

The insulating liner 16 is positioned within the cup, separating the cup from the contact. The thickness of the insulating liner will vary with the size of the primer and the electric potential to be supplied to the primer, as will be evident to those skilled in the art. The liner is preferably formed from polymeric material. In general, the insulating liner is prepared from at least one polymeric material having an Impact Toughness of at least about 1 ft-lb/in., a Heat Distortion Temperature at 264 psi of at least about 175° F. and a Modulus of Elasticity of at least about 130,000 psi., all as measured by conventional test procedures. Preferably, the polymeric material will have properties of a Heat Distortion Temperature of at least 310° F., Impact Toughness of at least 1.3 ft.-lb/in, and a Modulus of Elasticity of approximately 350,000 psi.

A wide variety of polymeric materials can be used, including polypropylenes, polycarbonates, polysulfones, poly(etherimides), poly(amide imides), poly(ether sulfones), poly(benzimide azolds), and poly(ether ether ketones). Of these, the mechanical and electrical properties of poly(ether ether ketones) (PEEK), which have an Impact Toughness of at least 1.55 ft.-lb/in, a Heat Distortion Temperature of at least 320° F. and a Modulus of Elasticity of approximately 400,000 psi as measured under conventional test procedures, have been found to be particularly satisfactory, and these polymers are accordingly preferred for use as an insulating liner in the present invention. In general, for those polymers having both a crystalline and an amorphous state, the amorphous state is preferred or a greater amorphous portion in semi-crystalline polymers is preferred, since this generally provides better toughness while only slightly compromising heat distortion temperature and chemical resistance.

The insulating material preferably further comprises a minor amount of conductive material such as carbon to obtain a material resistivity of at least about 100 ohm-cm. This further increases the number of shunt current paths within the primer, that is, from the contact to the cup. This further decreases ESD sensitivity. The specific concentration of the conductive material will vary with the specific insulating and the conductive material used, and should be sufficient to provide the desired conductivity but less than that which could depreciate the material strength properties of the polymer. Typically, higher concentrations of carbon fiber are needed to provide a desired level of resistivity than standard structure or high structure carbon black. In general, for the preferred PEEK polymeric materials, about 0.5 to 60% of carbon can be used. For carbon fiber, about 20% to 60% by weight generally is preferred for desired resistivity. For standard structure carbon black, such as that commercially available from Cabot Corporation as Vulcan XC-72, about 10% to 40% by weight can be used. With high structure carbon black, such as that commercially available from Akzo as Ketjenblack C-600 JD or from Degussa as Printex XE-2, approximately 0.5% to 12.0% by weight can be used effectively.

In still another embodiment of the invention, an adhesive can be used for the insulating liner. While a wide variety of adhesives can be used for such insulating liners, these materials generally should be substantially free from amines, which would desensitize the high explosive in the primer. Epoxies have been found to be particularly satisfactory in this embodiment.

The insulating liner 16 generally is configured to substantially fully separate the electrically conductive contact and the electrically conductive cup, and have a portion 16A extending toward the aperture in the bottom of the cup. In one preferred embodiment of the invention, the insulating liner extends into the aperture, to provide a physical barrier to prevent conductive fouling, and short circuiting the contact to the cup, and to further insure that the electric charge from the electrode or firing pin is directed to the contact and not to the cup. To aid in retaining the contact within the cup, the sides of the insulating liner are preferably provided with at least one protrusion 20 formed on the sides of the liner. The use of the insulating liner with the geometry of the primer cup and conductive contact tends to support the. contact and provide a bearing surface against which the contact is at least partially reshaped in response to the chamber pressures generated by the discharge of the primary and secondary explosive materials so as to fill and substantially seal the aperture of the cup behaving much like a valve seat.

The primer further comprises retaining means 17 typically positioned on top of the explosive charge. The specific retaining means can vary widely, and can include one or more of lacquer, metallic or non-metallic foil, and/or an anvil that is press fit into the cup. Foils and lacquers either of which can typically be used will be conductive and non-conductive. For example, lacquer can be used alone or in combination with a metal foil. To provide a conductive lacquer, at least about 0.5% by weight of conductive filler, such as carbon fiber, can be admixed therein. If a conductive foil is used as the retaining means, the foil should preferably exhibit a resistivity of about 1.5 to 12 microohm-cm at 20° C. The foil can furthermore be perforated which provides an additional advantage of aiding drying during the manufacturing process.

When an anvil is used as a retaining means, the configuration can vary widely, and will be adjusted to the manufacturing and performance requirements of the particular construction. An important requirement is the provision of a path for the explosive brisance to reach the aperture in the shell adjacent the secondary propellant charge. This can be, for example, a central path or aperture or circumferential notches or slots. For example, a disc with a central aperture can be used, with the disc being press fit into the cup. Another configuration is a trefoil, as shown in FIG. 1, which can also be press fit into the cup. In still another embodiment, a foil having a larger diameter than the cup can be press fit into the mouth or open upper end of the cup. The gathered outside edges of such an inserted foil will further aid in retaining the primer contents.

The configuration of the conductive contact and the retaining means is preferably adjusted so as to provide a substantially uniform distance between any point on the electrically conductive contact and the conductive retaining means. The retaining means can, and preferably does, include an anvil 18 positioned over the foil. The anvil can be press fit into the cup to aid in retention of the components after discharge of the explosive.

In addition, or in the alternative, other means for retaining the positioning of the components after discharge include heat staking of the top rim of the liner over the contact in the course of manufacture, or providing protrusion(s) on the inner surface of the liner so that a contact can be snapped into the liner and retained. Still another means for retaining the components includes providing a mouth on the liner which, after assembly, is smaller than the components. This can be provided with a draft angle on the external diameter of the liner, for example, of two degrees per side. After assembly, the material can be further moved radially inward by heat staking to make the mouth of the liner even smaller. This further facilitates the retaining of the components within the cup after firing.

The explosive should preferably be configured to provide substantially uniform distance between the contact and the retaining means. Accordingly, the explosive typically comprises a central depression 19 that generally conforms to the nipple portion 15 of the contact.

In the selection of materials and the construction configuration of the primer, it is generally desirable to maintain a static impedance as low as possible. In the preferred embodiments of the invention, using a conductive foil and an anvil, the impedance is about from 0.1 K ohms to 3 K ohms. In this manner, the sensitivity to ESD, magnetic fields, radio frequency transmitters and electromagnetic radiation can be significantly reduced. Multiple current paths through the homogeneous explosive mix combined with low static impedance results in lower currents in the respective current paths, and consequently reduced resistive heating. This reduction in resistive heating temperature will lessen the primer's susceptibility to these exterior natural stimuli (i.e. higher ESD and/or electromagnetic radiation levels are required to initiate the primer because of this built-in construction and features).

Figure 4:
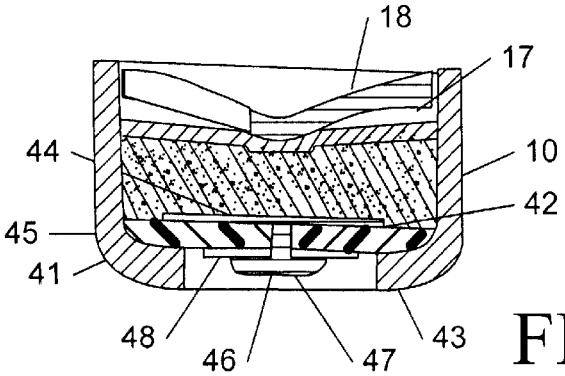
FIG. 4 is a cross-sectional view in elevation of a further alternative primer of the present invention.

A further alternative embodiment of the present invention is shown in FIG. 4, in which the contact and the liner are combined, such as in a single disc 41 positioned in the bottom of the cup. The disc comprises top and bottom surfaces 42 and 43, and a central conductive portion comprising a top portion 44 and a bottom portion 48. The bottom portion 48 is adjacent the aperture in the bottom of the cup, and is generally smaller in diameter than the aperture. The disc further comprises an annular portion 45 of electrically insulating material separating the cup from the central conductive portion. The central conductive portion is typically provided by plating areas on the top and bottom of the disc and electrically connecting these areas by an aperture through the disc filled with a conductive material 46, such as solder. The bottom of the conductive plating preferably further comprises a button 47 of conductive material such as solder.

In the embodiment shown in FIG. 4, the basic disc can be fabricated from a wide variety of commercially available materials typically used for circuit board manufacture. The central conductive portion of the disc can be a metal or other conductive material, typically nickel or copper.

The primers of the instant invention can be reliably activated by application of an by electrical current sufficient to ignite the explosive material, such as, for example a 130 volt–150 volt firing pulse or other voltage pulse, without the risk of induced activation by undesired sources, such as electrostatic discharge, magnetic fields, electromagnetic radiation, such as that emanating from electrical power lines and transformers, and radio frequency transmitters. In addition, the primers are of a size that can be readily and reliably used in small arms ammunition in which limited space is a critical design limitation. This provision of a primer small enough for use in small caliber sporting firearms was particularly difficult because of the restricted space available for a primer charge being of an adequate volume to reliably actuate the secondary propellant charge of the ammunition, combined with the need to withstand the high operating or chamber pressures of the secondary charge. The invention can accommodate primers as small as the smallest primers currently used in sporting ammunition.

While specific embodiments are described in the foregoing specification, variations and modifications of the specific components and their combination will be evident to those skilled in the art.

What is claimed is:

1. An electrically activated primer for use in small arms ammunition, comprising:

an electrically conductive cup having a bottom and opposed side walls defining an internal chamber, said bottom including an aperture formed therein;

wherein the primer is sized so as to have a primer volume within a range of approximately 0.001 cubic inches to 0.010 cubic inches;

a conductive explosive material received within said internal chamber in an amount sufficient to initiate firing of the ammunition;

a contact positioned within said internal chamber adjacent said bottom of said cup in contact with said explosive material for actuating said explosive upon application of an electrical charge, said contact having a reduced thickness sufficient to enable a desired volume of explosive to be received within said internal chamber, wherein said contact has a thickness of between approximately 0.010 inches and approximately 0.030 inches;

an insulating liner received within said cup for separating said contact from said cup; and a retaining means received within said cup for retaining said explosive material therein.

2. The primer of claim 1 and wherein said insulating liner comprises at least one polymeric material.

3. The primer of claim 2 and wherein said insulating liner comprises at least one polymeric material having an impact toughness of approximately 1 ft-lb/in, a heat distortion temperature of at least 175° F., and a modulus of elasticity of at least approximately 130,000 psi.

4. The primer of claim 1 and wherein said insulating liner is configured to fit between said contact and said cup to isolate said contact from said cup and retain said contact within said cup after discharge of said explosive.

5. The primer of claim 1 and wherein the desired quantity of explosive received within said internal chamber comprises approximately 12% to 18% of the primer volume.

6. The primer of claim 1 and wherein said contact includes a nipple portion that projects at least partially into said aperture formed in said bottom of said cup so that as said explosive material is exploded, said contact is at least partially reshaped to fill and seal said aperture without being reshaped to an extent that would cause rupture of the contact and permit high pressure gas leakage.

7. The primer of claim 1 and wherein said insulating liner includes a conductive material to provide shunt current paths from said contact to said cup.

8. An electrically actuated primer for small arms ammunition, comprising:

a cup having a bottom with an aperture formed therein and opposed side walls defining an internal chamber;

an electrically conductive explosive material received within said internal chamber of said cup;

a contact mounted adjacent to said bottom of said cup in contact with said explosive, said contact being formed from a deformable, electrically conductive material for transmitting an electric charge for activating said explosive material, and having a nipple portion which projects at least partially into said aperture of said cup to receive an electric charge for activating said explosive material, when said nipple portion is displaced from said bottom of said cup at least a distance h, wherein h is defined by the equation $$h=R+L-(\sqrt{(2R+2L)^{2-D^2}})/2$$

wherein

R is a radius of a tip of an electrostatic discharge source,

L is a maximum distance from said electrostatic discharge source to said nipple portion, and D is a diameter of said aperture; and, an insulating liner positioned between said cup and said contact for supporting and insulating said contact from said cup, whereby as an electric charge is transmitted through said contact and said explosive material is initiated said contact is reshaped against said insulating liner to substantially fill said aperture and seal said cup against gas leakage.

9. The electrically actuated primer of claim 8 and wherein the primer has a volume of less than approximately 0.010 cubic inch.

10. The electrically actuated primer of claim 9 and wherein said explosive material comprises approximately 12% to approximately 18% of the total volume of the primer.

11. The electrically actuated primer of claim 8 and wherein said cup is formed from an electrically conductive material.

12. The electrically activated primer of claim 8 and wherein said insulating liner is configured to fit between said contact and said cup to separate said contact from said cup and retain said contact within said cup after discharge of said explosive.

13. The electrically actuated primer of claim 8 and further including a retaining means received in said cup over said explosive for retaining said explosive within said internal chamber of said cup.

14. An electrically actuated primer for small arms ammunition, comprising:

a cup having a bottom with an aperture formed therein and opposed side walls defining an internal chamber;

an electrically conductive explosive material received within said internal chamber of said cup;

a contact mounted adjacent said bottom of said cup in contact with said explosive, said contact being formed from a deformable, electrically conductive material for transmitting an electric charge for actuating, said explosive material, and having a nipple portion which projects at least partially into said aperture of said cup to receive an electric charge for actuating said explosive material, wherein said contact has a thickness of approximately 0.010 inches to approximately 0.030 inches; and an insulating liner positioned between said cup and said contact for supporting and insulating said contact from said cup, whereby as an electric charge is transmitted through said contact and said explosive material is initiated, said contact is reshaped against said insulating liner to substantially fill said aperture and seal said cup against gas leakage.

15. The electrically actuated primer of claim 14 and wherein said cup is formed from an electrically conductive material.

16. The electrically actuated primer of claim 14 and wherein said nipple portion of said contact has a thickness of approximately 0.010 inch to approximately 0.015 inch.

17. The electrically activated primer of claim 14 and wherein said insulating liner is configured to fit between said contact and said cup to separate said contact from said cup and retain said contact within said cup after discharge of said explosive.

18. The electrically actuated primer of claim 14 and further including a retaining means received in said cup over said explosive for retaining said explosive within said internal chamber of said cup.

19. The electrically actuated primer of claim 14 and wherein the primer has a volume of less than approximately 0.010 cubic inch.

20. The electrically actuated primer of claim 14 and wherein said explosive material comprises approximately 12% to approximately 18% of the total volume of the primer.

* * * * *